United States Patent [19]

Boelen

[11] Patent Number: 4,558,617

[45] Date of Patent: Dec. 17, 1985

[54] DEVICE FOR CUTTING AN ELONGATE PAPER ROLL

[75] Inventor: Adrianus G. M. Boelen, Tilburg, Netherlands

[73] Assignee: Rolco International B.V., Tilburg, Netherlands

[21] Appl. No.: 570,961

[22] Filed: Jan. 16, 1984

[30] Foreign Application Priority Data

Jan. 22, 1983 [NL] Netherlands ..... 8300235

[51] Int. Cl.[4] ..... B26D 1/03; B26D 1/143

[52] U.S. Cl. ..... 83/425.1; 83/425.2; 83/676

[58] Field of Search ..... 83/329, 425.1, 425.2, 83/425.3, 425.4, 424, 431, 447, 471.1, 471.2, 474, 508.3, 676

[56] References Cited

U.S. PATENT DOCUMENTS

| | | | |
|---|---|---|---|
| 3,349,822 | 10/1967 | Rauth | 83/425.2 |
| 4,329,835 | 5/1982 | Perini | 83/425.3 |
| 4,351,459 | 9/1982 | Huey-Miin | 83/425.1 |

FOREIGN PATENT DOCUMENTS

| | | | |
|---|---|---|---|
| 3045678 | 7/1982 | Fed. Rep. of Germany | 83/508.3 |
| 2504443 | 10/1982 | France | 83/508.3 |
| 36239 | 2/1968 | Japan | 83/425.2 |
| 135083 | 11/1978 | Japan | 83/508.3 |
| 408798 | 2/1972 | U.S.S.R. | 83/676 |
| 579159 | 11/1977 | U.S.S.R. | 83/676 |

*Primary Examiner*—Frank T. Yost
*Assistant Examiner*—Hien Hi Phan
*Attorney, Agent, or Firm*—Allen D. Gutchess, Jr.

[57] ABSTRACT

A device for cutting an elongate paper roll into a plurality of small rolls comprising at least one cutting disc adapted to rotate about a rotary axis during operation whereby the device is provided with a plurality of cutting discs rotatable about rotary axes being in fixed positions during operation and with means for displacing the elongate paper roll with respect to the cutting discs in a direction at least substantially normal to the rotary axes of the cutting discs, while, viewed in the direction of displacement of the elongate paper roll, the cutting discs are relatively off-set in a manner such that an outermost portion of the paper roll is cut off at least for the major part before the cutting disc cutting off the adjacent portion of the paper roll engages the elongate paper roll.

1 Claim, 6 Drawing Figures

DEVICE FOR CUTTING AN ELONGATE PAPER ROLL

The invention relates to a device for cutting an elongate paper roll into a plurality of small rolls comprising at least one round cutting disc adapted to rotate about a rotary axis in operation.

Such a device may be used for dividing an elongate paper roll into small rolls, for example, closet rolls or so-called kitchen rolls, that is to say, paper rolls having a length about twice that of a common closet roll and used as paper towels.

The known devices for this purpose comprise a single cutting disc mounted on the end of a pivotable arm. The elongate paper roll is stepwise displaced over a distance equal to the desired length of the small roll in its direction and length and after each displacement the cutting disc rotating during operation is turned down to cut a portion from the elongate paper roll.

Both the mechanism for turning the cutting disc and the cutting disc itself are subjected to heavy wear so that the cutting disc has to be ground and/or replaced within a relatively short time, whilst the further part of the device also requires much maintenance.

The invention has for its object to provide a device of the kind set forth in which the disadvantages inherent in the known device can be obviated.

According to the invention this can be achieved in that the device is provided with a plurality of cutting discs rotatable about rotary axes having a fixed position during operation and with means for displacing the elongate paper roll with respect to the cutting discs in a direction normal to the rotary axes of the cutting discs, whilst, viewed in the direction of displacement of the elongate paper roll the cutting discs are relatively offset in a manner such that an outermost portion of the paper roll is cut off at least for the major part before the adjacent portion of the paper roll is engaged by the next cutting disc.

By using the design in accordance with the invention the cutting discs can be arranged stationarily which contributes to a simplification of the arrangement and the drive of the cutting discs. Since the paper roll is cut with the aid of a plurality of cutting discs, the cutting discs will have a considerably longer operational time so that grinding or replacement of the cutting discs is appreciably less frequent than in the known device. The resultant labour saving and the gain of useful operational time of the device largely compensate for the costs initially required for the arrangement of a plurality of cutting discs.

Since it is furthermore ensured that one end of a paper roll is invariably cut off at least substantially completely before a cut is started for cutting off a next portion of the paper roll, the exertion of undesirable forces on the paper roll due to the fact that the cutting disc has a given thickness and hence, when making the cut, the parts located on both sides of the cutting disc have to be relatively displaced in the direction of length of the roll is avoided.

The invention will now be described more fully with reference to an embodiment of the construction in accordance with the invention schematically shown in the accompanying drawing.

Figure 1:
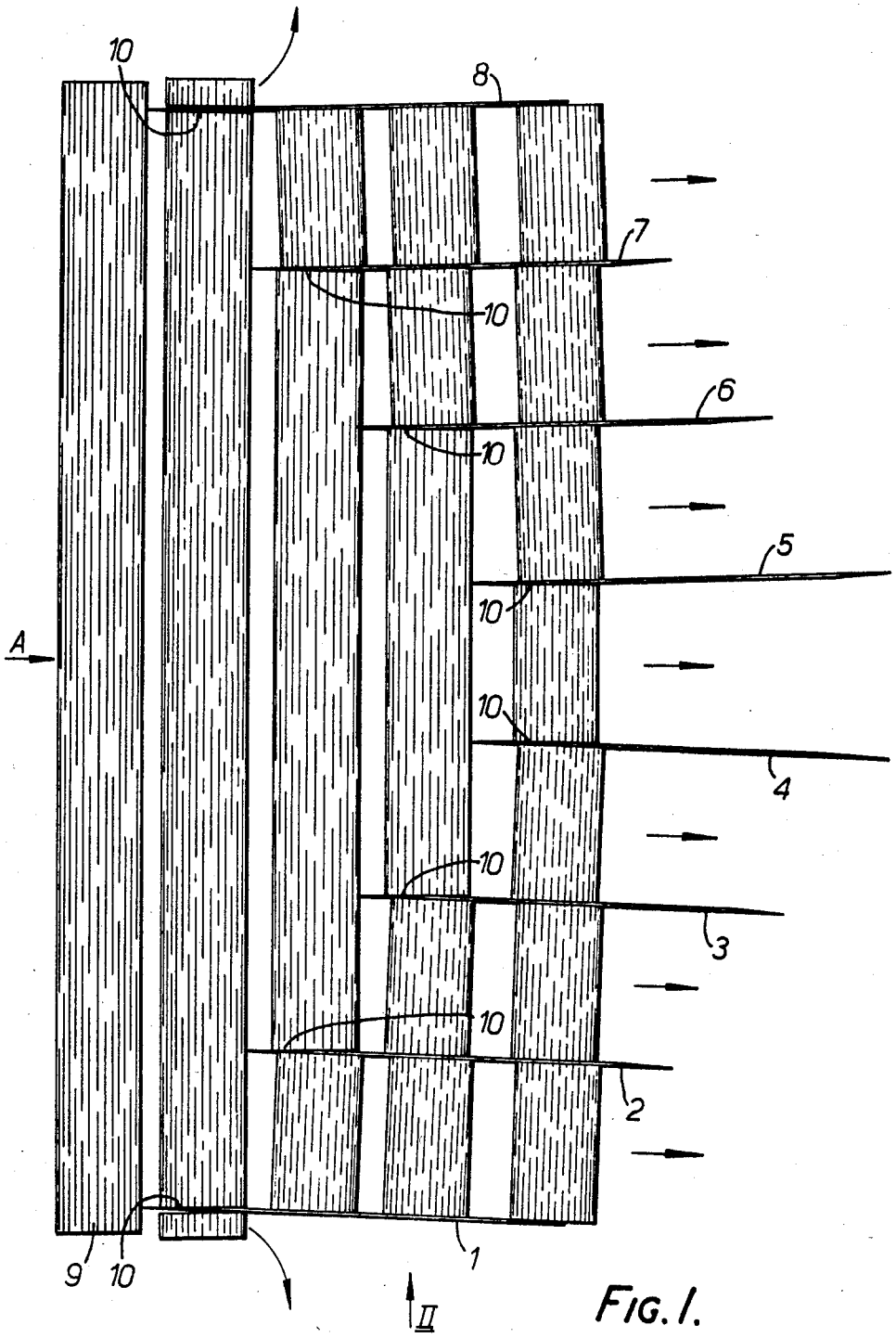
FIG. 1 is a schematic plan view of the cutting discs of a device embodying the invention.
Figure 2:
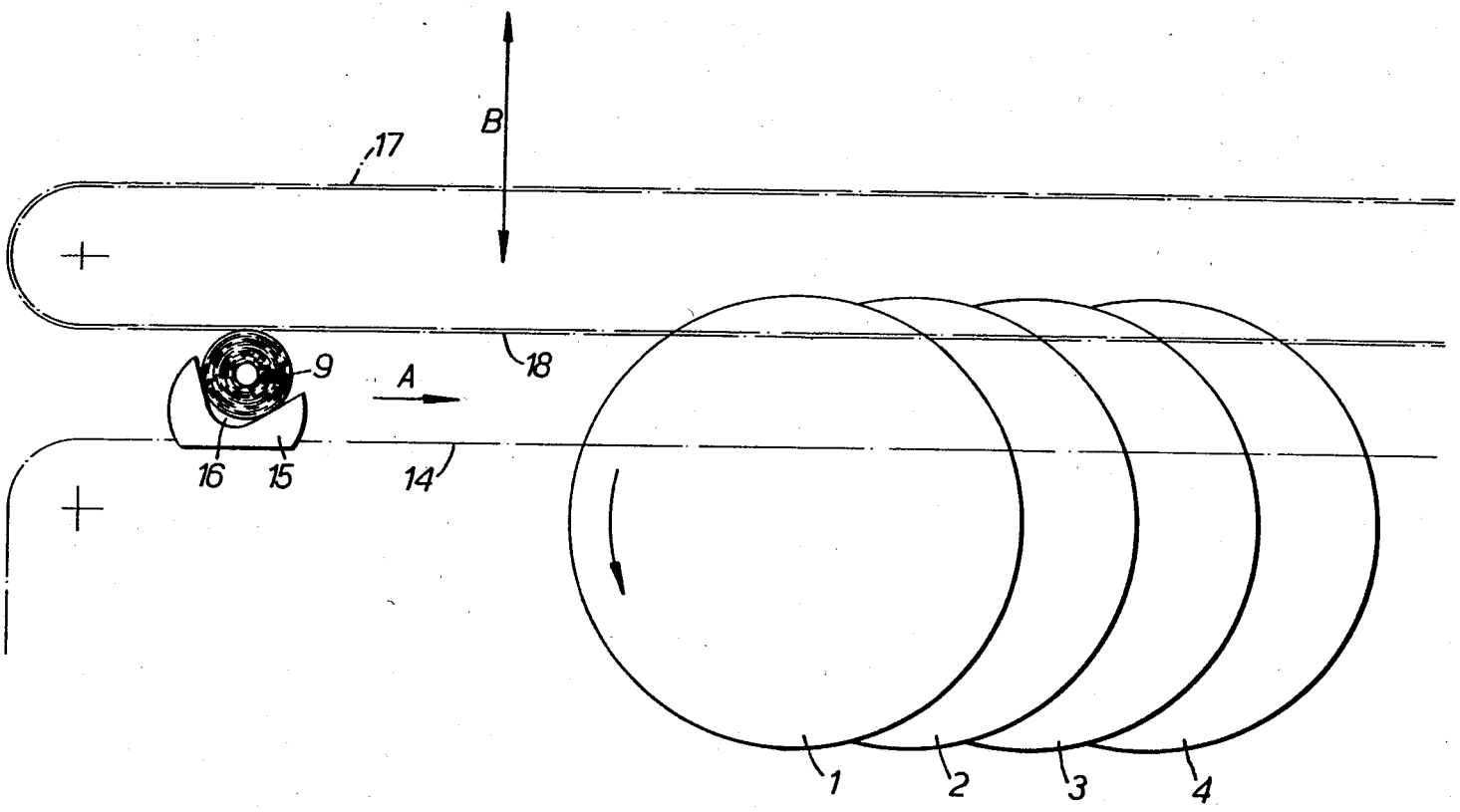
FIG. 2 is a schematic side elevation of part of the device embodying the invention taken in the direction of the arrow II in FIG. 1.
Figure 3:
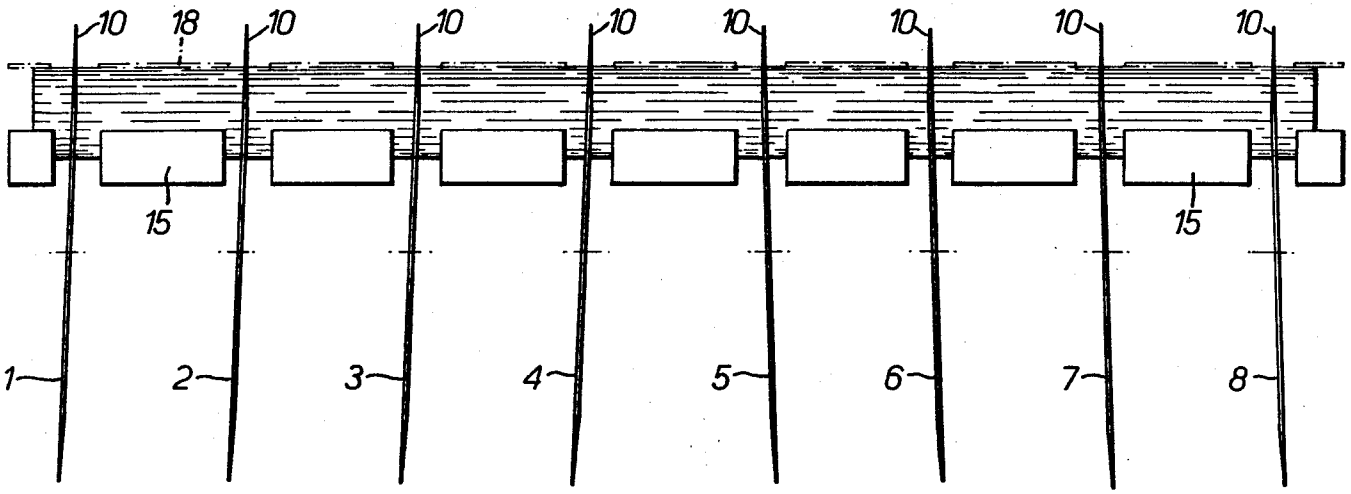
FIG. 3 is an elevational view of part of FIG. 2 viewed from the left in FIG. 2.

Referring in particular to FIGS. 1 and 3 the device in the embodiment shown comprises eight cutting discs 1 to 8 with respect to which elongate paper rolls 9 to be cut into a plurality of portions are displaceable in the direction of the arrow A, that is to say, at least substantially at right angles to the at least substantially horizontal rotary axes of the cutting discs 1 to 8.

With respect to the outermost cutting discs 1 and 8, the foremost points of which are located at least substantially in a vertical plane, the neighbouring discs 2 and 7 are displaced to the rear in the direction of displacement A over a distance which is preferably equal to the largest diameter of a paper roll 9 which has to be worked by the device embodying the invention. The cutting discs 3 and 6 adjacent the cutting discs 2 and 7 are rearwardly set off over the same distance with respect to the discs 2 and 7 in the direction of the arrow A. The same applies to the disposition of the discs 4 and 5 with respect to the neighbouring discs 3 and 6.

Figure 4:
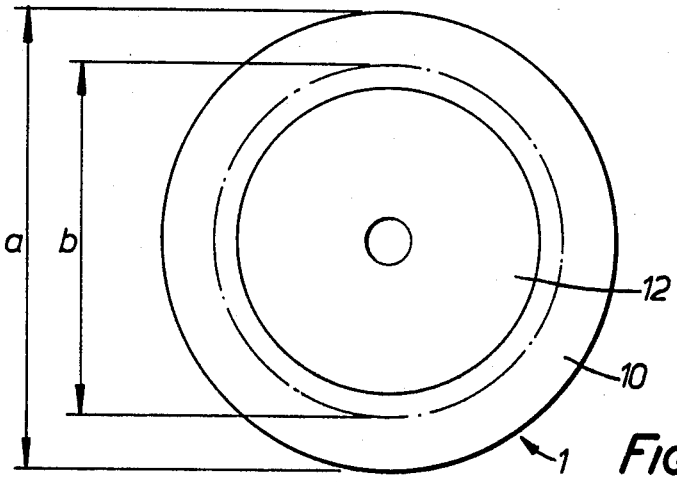
FIG. 4 is an elevational view of a cutting disc viewed in the direction of the rotary axis of the knife disc.
Figure 5:
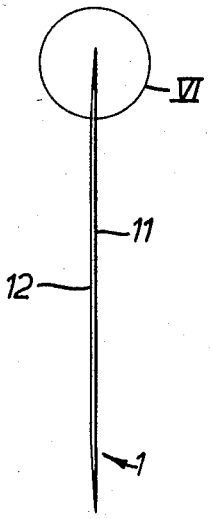
FIG. 5 is a side elevation of the disc of FIG. 4.
Figure 6:
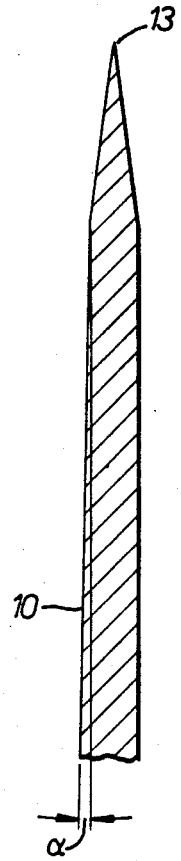
FIG. 6 shows on an enlarged scale the part VI encircled in FIG. 5.

FIGS. 4 and 5 show that a cutting disc is formed by a metal plate having a thickness of about 3 mms, the outer part of a plate having a tapering shape in that the plate is bevelled on one side near the outer circumference to form a face 10 being at an angle $\alpha$ of about 1° to the side faces 11 and 12 of the disc being at right angles to the rotary axis of the disc. From FIG. 6 it is apparent that the outer edge of the disc is ground to form a cutting edge 13.

FIG. 4 furthermore illustrates that this cutting disc can be repeatedly ground, whilst the initial diameter of the cutting disc may be reduced to a minimum diameter b. In practice the initial diameter a is chosen to be 610 mms so that such a cutting disc can be used until a minimum diameter b of 460 mms is attained.

From FIGS. 1 and 3 it is apparent that the rotary axes of the cutting discs are not parallel to the longitudinal axis of a paper roll to be cut into portions; the rotary axes of the discs are at an angle to said longitudinal axis. Viewed on plan (FIG. 1) the disposition of each cutting disc is such that the boundary face 10 of the outer part of the cutting disc concerned, which is at an angle of about 1° to a plane normal to the rotary axis of the cutting disc concerned, is at right angles to the longitudinal axis of the paper roll to be worked. Said boundary face is turned away from the portion of the paper roll to be cut off by the disc concerned. In the embodiment shown the boundary faces 10 of the two foremost cutting discs 1 and 8 are, therefore, facing one another. This also applies to the boundary faces 10 of the cutting discs 2 and 7, 3 and 6 and 4 and 5 disposed at the same height.

Not only viewed on plan are the rotary axes of the cutting discs at an angle of at least substantially 1° to the longitudinal axis of a paper roll to be cut into portions, but also in a side elevation (FIG. 3) the rotary axes of the cutting discs are at an angle of at least substantially 1° to the longitudinal axis of the paper roll to be cut up so that, viewed from aside, the boundary faces 10 of the various knives are at least substantially vertical.

For transporting the elongate paper roll to be cut up endless, drivable transport chains 14 or similar transport members are arranged between the cutting discs and at the side of the outermost cutting discs. These transport members are provided with catches 15 having V-shaped recesses for receiving the paper rolls 9.

The transport chains 14 or the like are guided so that the upper runs of these transport chains 14 or the like arranged side by side are located in a horizontal plane so that a paper roll 9 carried by the catches 15 of the adjacent transport chains 14 can be displaced in the direction of the arrow A.

In order to prevent the paper rolls 9 from being pushed out of the V-shaped recesses 16, endless chains 17 are arranged above the transport members 14, plate-shaped parts 18 being fastened to the links of the chains 17. The disposition is such that the plates 18 fastened to the lower runs of the chains 17 are located in a horizontal plane. The transport chains 17 are arranged in a frame part which is adjustable in a direction of height as is indicated by the arrow B for matching the diameter of the paper rolls 9 to be worked. The adjustment is carried out so that the plate-shaped parts 18 of the endless chains will just bear on the top side of the paper roll 9 to be worked.

During operation the cutting discs 1 to 8 are turned. Since the rotary axes of the cutting discs 1 to 4 are parallel to one another as well as the rotary axes of the cutting discs 5 to 8, the cutting discs 1 to 4 can be effectively coupled with one another and be driven, for example, from one side of the device, whilst in a similar manner the cutting discs 5 to 8 may be coupled with one another and driven from the other side of the device.

It will be apparent from FIG. 1 that during the displacement of a paper roll 9 invariably the outermost portions are cut off the paper roll before knives disposed further to the rear, viewed in the direction of displacement, engage the paper roll. In this way undesirable forces occurring when cutting discs simultaneously penetrate at several places into the paper roll, are avoided. Owing to this precaution and to the above-described disposition of the rotary axes of the cutting discs matching the variation of the boundary face 10 it is ensured that the portions of the paper roll will be cut off perpendicularly.

It will be obvious that within the spirit and scope of the invention modifications and complementary steps in the above-described embodiment are possible.

For example, the device may be equipped with more or fewer cutting discs than eight in dependence of the length of the basic product 9 and the desired length of the ready products.

Furthermore, the cutting discs may all be arranged in a single row inclined to the direction A.

I claim:

1. A device for cutting an elongate paper roll into a plurality of small rolls, said device comprising a plurality of cutting discs adapted to rotate each about rotary axis which is in a fixed position during operation, means for displacing the elongate paper roll with respect to said cutting discs in a direction generally at right angles to the rotary axes of said cutting discs, said cutting discs being offset in the direction of displacement of the paper roll in a manner such that an outermost portion of the paper roll is substantially cut off before the next cutting disc cutting off the adjacent portion of the paper roll engages the paper roll, each of said cutting discs having two boundary faces, one of which is at right angles to the rotary axis of the cutting disc and the other of which is inclined at a narrow angle to a plane at right angles to the rotary axis of the cutting disc, said cutting disc being disposed so that the inclined boundary face is substantially at right angles to the longitudinal axis of the elongate paper roll at the level where the cutting disc engages the paper roll, and said inclined boundary face faces away from the portion of the paper roll to be cut off by the cutting disc concerned.

* * * * *